US005706935A

United States Patent [19]

Lorton

[11] Patent Number: 5,706,935

[45] Date of Patent: Jan. 13, 1998

[54] PERSONAL ARTICLE RECEPTACLE

[76] Inventor: Carol Lorton, 3 Winding Hollow Trail, Dayton, Ohio 45414

[21] Appl. No.: 604,050

[22] Filed: Feb. 20, 1996

Related U.S. Application Data

[63] Continuation-in-part of Ser. No. 315,769, Sep. 30, 1994, abandoned.

[51] Int. Cl.[6] ..... B65D 85/38

[52] U.S. Cl. ..... 206/38; 150/117; 206/5; 206/6

[58] Field of Search ..... 150/112–117; 206/5, 206/6, 38

[56] References Cited

U.S. PATENT DOCUMENTS

| | | | |
|---|---|---|---|
| 1,025,372 | 5/1912 | Conrad | 206/5 |
| 1,919,262 | 7/1933 | Shields | 206/6 |
| 2,183,428 | 12/1939 | McNary | 206/38 |
| 2,499,332 | 2/1950 | Schiff | 206/5 |
| 2,634,018 | 4/1953 | Mageau, Jr. | 206/6 |
| 2,710,685 | 6/1955 | Baratelli | 206/5 |
| 3,070,141 | 12/1962 | Lowry | 206/5 |
| 3,144,127 | 8/1964 | Fogel | 206/5 |
| 4,161,201 | 7/1979 | Carp | 150/113 |
| 4,192,365 | 3/1980 | Siegel | 150/112 |
| 4,257,463 | 3/1981 | Monaco | 206/5 |
| 4,609,084 | 9/1986 | Thomas | 190/110 |
| 4,867,215 | 9/1989 | Macieowitz | 150/112 |
| 4,887,751 | 12/1989 | Lehman | 190/110 |
| 4,951,811 | 8/1990 | Lines | 206/5 |
| 5,016,749 | 5/1991 | Kaye et al. | 206/5 |
| 5,299,682 | 4/1994 | Tatar | 206/5 |

*Primary Examiner*—Jimmy G. Foster
*Attorney, Agent, or Firm*—Harrison & Egbert

[57] ABSTRACT

A personal article receptacle including a case having a front side and a back side, and an eyeglass holder affixed to the interior of the case. The eyeglass holder has a front generally rigid side and a back generally rigid side. The front and back sides define an eyeglass receiving space therebetween. The eyeglass holder has an edge affixed to a bottom side of the case. The eyeglass holder extends upwardly from the bottom side. The eyeglass holder is positioned generally centrally between the front side and the back side and has an opening facing the top of the case. A section of flexible material extends between the front and back rigid sides and includes a zipper extending therealong.

15 Claims, 6 Drawing Sheets

400
402
404
406
408
410
412
414
416
418
420
422
424
426
428
430
432
434
436
438
440
442
450
452
454
131
14

PERSONAL ARTICLE RECEPTACLE

RELATED APPLICATIONS

The present application is a continuation-in-part of U.S. patent application Ser. No. 08/315,769, filed on Sep. 30, 1994, and entitled "PERSONAL ARTICLE RECEPTACLE", abandoned.

TECHNICAL FIELD

The present invention relates to purses and carrying cases. More particularly, the present invention relates to eyeglass holders. Furthermore, the present invention relates to carrying cases that include eyeglass holders.

BACKGROUND ART

A common problem facing those persons that wear eyeglasses is the difficulty of carrying such eyeglasses when they are not in use. For those persons that do not have to wear eyeglasses on a full time basis, it is always necessary to carry around a case for the protection and storage of the eyeglasses. In many circumstances, women attempt to place an eyeglass case within a small purse. However, the bulky eyeglass case occupies most of the interior of the small purse and displaces other articles of necessity. Herein lies the crux of the problem. A choice now must be made, none of which provide a satisfactory solution. For example, the protective case containing the eyeglasses can be carried separately from the purse in a hand or a pocket at the risk of loss; the eyeglasses can be placed unprotected into the purse independent of the case at the risk of damage; or as usually is the case, a larger purse can be carried.

Today, however, more and more women express major concerns about large purses and handbags, and they prefer not to carry them on a daily basis when shopping, doing errands, or going out in the evening. Common complaints are that large handbags are difficult to conceal, making them a target for theft. They invariably will accumulate unnecessary articles making them heavy and uncomfortable to carry. They become disorganized making specific needed articles located deep within, such as eyeglasses and car keys, difficult to access.

A variety of patents have issued in the past that describe apparatus for carrying eyeglasses in combination with purses. For example, U.S. Pat. No. 4,257,463, issued on Mar. 24, 1981, to R. Monaco discloses a combination attache case, handbag, and shoulder bag. A soft unstructured eyeglass pouch is dimensioned to fit into an external pocket of the attache case. The pouch is releasably joined to the attache case by a chain fixed at one end to a zipper support strip and provided at a remote end with a spring-release fastener. The use of separate unstructured pouches in combination with pockets to retain them is a common means for carrying eyeglasses. However, this technique is generally associated with problems and disadvantages, and it in no way suggests a solution for persons who prefer to carry a small organized purse or wallet that will store and positively protect eyeglasses from loss or damage.

U.S. Pat. No. 2,183,428, issued on Dec. 12, 1939, to A. H. McNary and U.S. Pat. No. 4,609,084, issued on Sep. 2, 1986, to F. O. Thomas disclose the use of various partitions, straps and pouches for temporarily holding and storing articles within a purse or carrying case. The object of this technique is to facilitate the organization and accessibility of articles, such as a separate eyeglass case, when retained within a purse. However, this concept promotes the repetitious removal of the eyeglass holder itself and in no way relates to or suggests the permanent integration of a rigid protective eyeglass receiving space within a small organized purse or wallet.

U.S. Pat. No. 3,144,127, issued on Aug. 11, 1964, to W. Fogel discloses an eyeglass case that is designed to be flexible and, with the use of a fold score, to fold flat. While this collapsible case does protect eyeglass lenses from getting scratched, it lacks the necessary rigidity and interior spacer means to adequately protect eyeglasses from structural damage that often results from the pressure of other articles simultaneously held within the interior of a small purse or carrying case.

U.S. Pat. No. 2,710,685, issued on Jun. 14, 1955, to C. A. Baratelli and U.S. Pat. No. 5,016,749, issued on May 21, 1991, to K. and B. Kaye disclose conventional rigid eyeglass cases that do successfully protect eyeglasses from structural damage. However, the conventional case is too bulky to carry on the interior of a small purse or wallet without displacing other articles of necessity. When the separate eyeglass case is carried within a purse, it always creates inconvenience for the user. In addition to removing the eyeglasses, the case also must repetitiously be transferred to end from the purse each time the eyeglasses are needed. Therefore, the eyeglass case is often retained separate from the purse in a hand or a pocket at the risk of loss.

It is an object of the present invention to provide a novel personal article receptacle that includes a permanently integrated means for receiving eyeglasses on the interior thereof, thereby obviating the need for a separate eyeglass case.

It is another object of the present invention to provide a personal article receptacle that includes an eyeglass receiving space that provides adequate rigidity and spacer means for positive protection of eyeglasses contained therein.

It is another object of the present invention to provide a personal article receptacle that stores eyeglasses in a prominent, readily and independently accessible position on the interior thereof.

It is another object of the present invention to provide a personal article receptacle that includes an article receiving space on the interior to receive all of the articles generally contained in a wallet, in conjunction with the eyeglass receiving space, giving the receptacle the dual function of an eyeglass case and a wallet.

It is still a further object of the present invention to provide a personal article receptacle that facilitates the organization of every other article of necessity that must be carried on the person when departing from home.

It is still a further object of the present invention to provide a personal article receptacle that is of a small compact size, light in weight, easy to carry and conceal, and easy to slide into a larger handbag or tote bag when needed.

It is still another object of the present invention to provide a personal article receptacle that is relatively inexpensive, easy to manufacture, aesthetically pleasing and easy to use.

These and other objects and advantages of the present invention will become apparent from a reading of the attached specification and appended claims.

SUMMARY OF THE INVENTION

The present invention is a personal article receptacle that comprises a case having a front side and a back side and a means for opening the case so as to access an interior of the case, and an eyeglass holder permanently affixed into the interior of the case. The eyeglass holder has a front generally rigid side and a back generally rigid side. The front and the back sides define an eyeglass receiving space therebetween. The eyeglass holder includes means for closing the eyeglass receiving space. In the present invention, the case is of a compact configuration. The receptacle is precisely dimensioned to carry articles restricted to the articles deemed necessary by the person upon departing from home. For example, the length is determined by the length of a checkbook. The width is determined by the width of the ID holder, which, in turn, is determined by the length of a driver's license. The depth is determined by the combined depth of a checkbook, the ID holder, and address book, a note pad, plus the width of the eyeglass holder. The existing area surrounding the contour of the eyeglass holder is utilized to organize an exclusive assortment of personal articles.

Specifically, the case has a length of less than eight inches, a width of less than five inches, and a depth of less than three inches. The case has a generally rectangular configuration. A zipper extends around a portion of the periphery of the case. The zipper is positioned generally centrally of the depth dimension of the case and extends along three sides of the case. Specifically, in the preferred embodiment of the present invention, the zipper is of a double zipper configuration which meets at the top side of the case.

A removable strap extends outwardly of the case. The strap has one end connected to one side of the case and an opposite end connected to another side of the case.

The back rigid side of the eyeglass holder defines a partition which has an edge permanently affixed to a bottom side of the case. The eyeglass holder extends upwardly of this bottom side. The eyeglass holder is positioned centrally between the front side and the back side of the case. The eyeglass receiving space opens toward the top side of the case. The eyeglass receiving space has a flap which has one lengthwise side attached to the back rigid side of the eyeglass partition and includes a zipper. One lengthwise edge of the zipper is attached to the top edge of the eyeglass partition and the opposite lengthwise edge of the zipper is attached to the flap. When the zipper is closed, the flap then extends from the back rigid side of the eyeglass receiving space so as to overlap the front rigid side of the receiving space. A snap is provided to allow the flap to be removably attached at the front rigid side. As a result, the eyeglass receiving space can open in two ways. The eyeglasses can be accessed directly by using the zipper of the eyeglass receiving space which is adjacent to the zipper of the carrying case. This allows the eyeglasses to be accessed and removed directly from the carrying case. Second, the eyeglasses can be accessed and removed by unsnapping the flap in the conventional way.

The eyeglass holder defines a center partition in the interior of the case. The eyeglass holder is in a stationary position. The eyeglass holder is contoured to scale to maximize the space on the interior of the case for the organization of additional necessary articles. The case has a first area on one side of the eyeglass holder for receiving a first set of personal articles and a second area on the opposite side of the eyeglass holder for receiving a second set of personal articles. The eyeglass holder has a height less than the height of the case so as to provide a third area on the top of the eyeglass holder for receiving a third set of personal articles. The eyeglass holder has a length less than a length of the case so as to provide an area at an end of the eyeglass holder for receiving a fourth set of personal articles. The eyeglass holder has a pouch beneath it, at the base of the partition, which provides an area so as to receive a fifth set of personal articles.

DETAILED DESCRIPTION OF THE INVENTION

Figure 1:
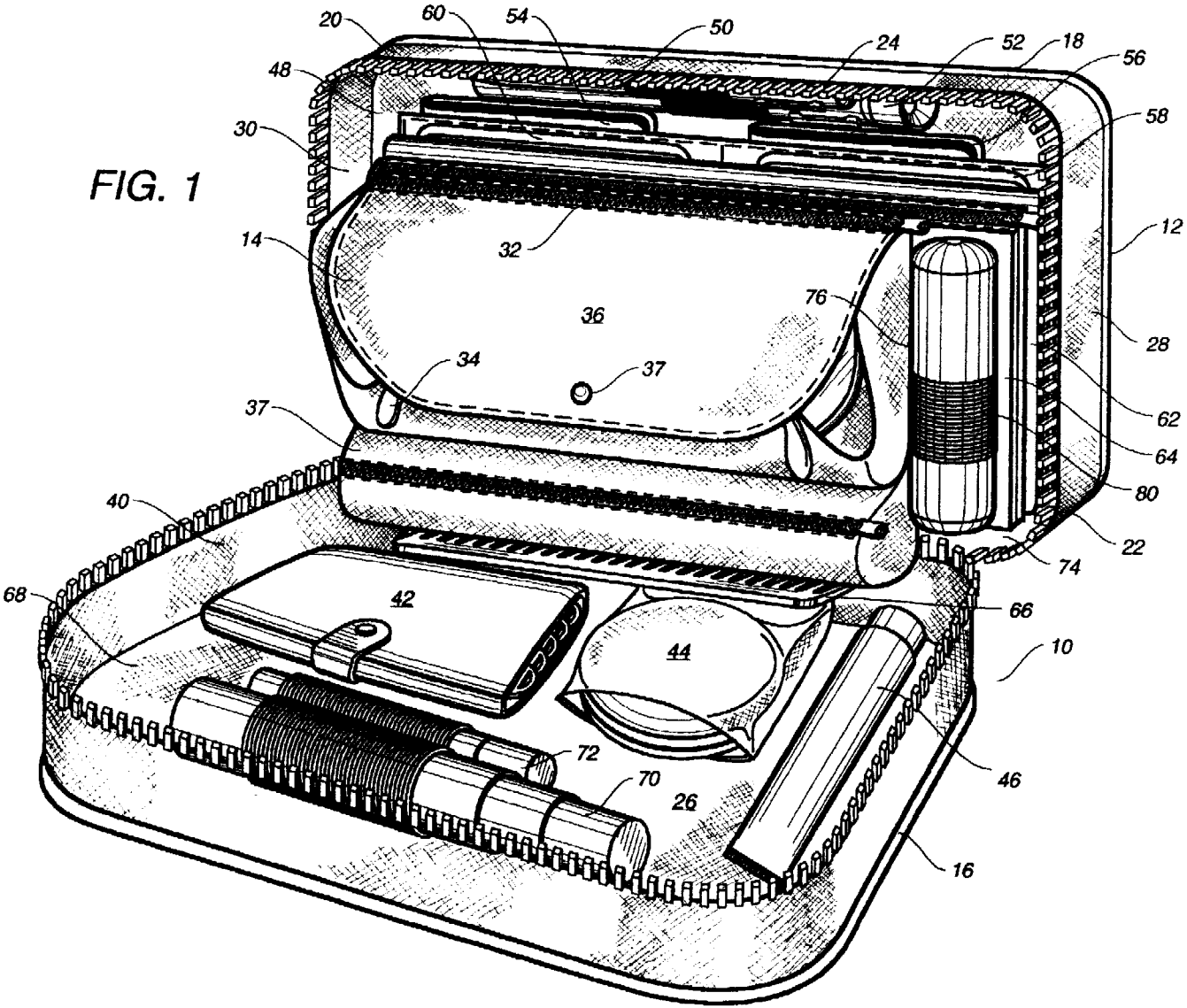
FIG. 1 is a perspective view of the personal article receptacle in accordance with the preferred embodiment of the present invention.

Referring to FIG. 1, there is shown at 10 the personal article receptacle in accordance with the preferred embodiment of the present invention. The personal article receptacle 10 includes a carrying case 12 and an eyeglass holder 14. The carrying case 12 is a small tote bag constructed in accordance with the present invention. As can be seen, the carrying case 12 has a front side 16 and a back side 18. A top side 20 extends between the front side 16 and the back side 18. A bottom side 22 also extends between the front side 16 and the back side 18. The top side 20 includes a zippered opening 24 for opening the case 12 so as to access the interior 26 of the case.

In the present invention, the case has a length of less than eight inches, a width of less than five inches, and a depth of less than three inches. These dimensions are of particular importance in the present invention since they provide the smallest possible compact purse that is able to accommodate items and to completely protect glasses contained therein. These dimensions were only obtained after a great deal of experimentation and development occurred. Even though the space is small, the glasses can be securely contained. Additionally, even within this small volume, the eyeglasses can be accessed from the top of the case without disturbing other items in the case. Without these dimensions, the present invention would be bulky and generally unsuitable for conventional use. The personal article receptacle 10, of the present invention, is of an extremely compact size. As such, the personal article receptacle 10 is easy to carry, easy to access, convenient to use and easy to conceal.

It can be seen in FIG. 1 that the case 12 has a generally rectangular configuration. The zipper 24 is configured so as to extend around a portion of the periphery of the case 12. Specifically, the zipper 24 is positioned between the front side 16 and the back side 18 of the case. The zipper 24, as shown in its opened configuration in FIG. 1, extends around three sides of the case 12. The zipper 24 also extends slightly into the bottom side 22 on each side so as to allow the case to hinge fully open and lie flat. Specifically, the zipper 24 extends around a side panel 28, the top side 20 and an opposite side panel 30. As such, when the zipper 24 is completely unzipped, the entire interior 26 of the personal article receptacle 10 is exposed for clear viewing and access by the user.

The eyeglass holder 14 is permanently affixed within the interior 26 of the case 12. As will be described hereinafter, the eyeglass holder 14 has a front generally rigid side and a back generally rigid side. The front and back sides define an eyeglass receiving space therebetween. A zippered area 32 is provided along the top edge of the eyeglass holder 14 so as to allow for access to the interior of the eyeglass holder 14. The zipper 32 allows the eyeglass holder 14 to be opened and closed. As can be seen in FIG. 1, eyeglasses 34 are contained within the eyeglass receiving space of the eyeglass holder 14. The eyeglass holder 14 defines a partition which has an edge which is affixed to the bottom side 22 of the case 12. It can be seen that the eyeglass holder 14 extends upwardly from the bottom side 22. The eyeglass holder 14 is positioned centrally between the front side 16 and the back side 18 of the case 12. The eyeglass receiving space on the interior of the eyeglass holder 14 opens toward the top side 20 of the case 12. A section of flexible material 36 extends between the front and back sides of the eyeglass holder. The zipper 32 is formed on the section of flexible material 36. In its normal configuration, the zipper 32 will be adjacent to the zipper 24 of the case 12. The eyeglass holder 14 also has a receptacle 37 formed at the bottom of the partition. This receptacle has a zipper 39 extending thereacross. This receptacle is in the form of a pouch. The section of flexible material 36 serves as a flap which covers the eyeglass holder. A snap fastener 37 is secured to the section 36 so as to releasably close the interior of the eyeglass holder 14.

The interior 26 of the case 12 is covered with a lining material. The front and back sides of the eyeglass holder 14 are covered with a similar lining material. The eyeglass holder 14 is maintained in a stationary position. The flexible material section 36 is a flap which extends from one of the rigid sides so as to overlap the other of the rigid sides.

The eyeglass holder 14 defines a first personal article receiving area 40 on the interior 26 of the case 12. This first area 40 is an area for receiving keys 42, a compact 44, and hand cream 46.

The eyeglass holder 14 also serves as a center partition so as to define a second personal article receiving area 48. The second personal article receiving area can contain an ink pen 50, a penlight 52, an address book 54, a notepad 56, a driver's license 58, credit cards 60, a checkbook 62, and a currency pouch 64 (described in greater detail in FIG. 7). A comb 66 is removably placed at the bottom of the eyeglass holder 14.

Importantly, in the present invention, it can be seen that the eyeglass holder 14 has a height which is less than the height of the case 12. As such, a third personal article receiving area 68 is defined between the top of the eyeglass holder 14 and the inner surface of the top side 20 of the case 12. This third area 68 is suitable for receiving hair spray 70 and breath spray 72. When the case 12 is closed, then the sprays 70 and 72 will be in proximity to the zipper 24 so as to allow easy access by the user of the personal article receptacle 10. There is no need to completely open the case to access such articles.

Also, importantly, it can be seen that the eyeglass holder 14 has a length which is less than a length of the case 12. As such, a fourth area 74 for the receipt of personal articles is formed between the edge 76 of the eyeglass holder 14 and the inner surface of the side wall 28 of the case 12. This area can be used for the receipt of lipstick 80. As can be seen, the configuration of the interior 26 of the case 12, including the fixed eyeglass holder 14, facilitates the organization of personal items on the interior of the case. Each of these items can be removed separately, as required by the user. Since a double zipper 24 is used for the case 12, access to the interior of the case 12 and to each of the items on the interior 26 of the case 12 is facilitated.

Figure 2:
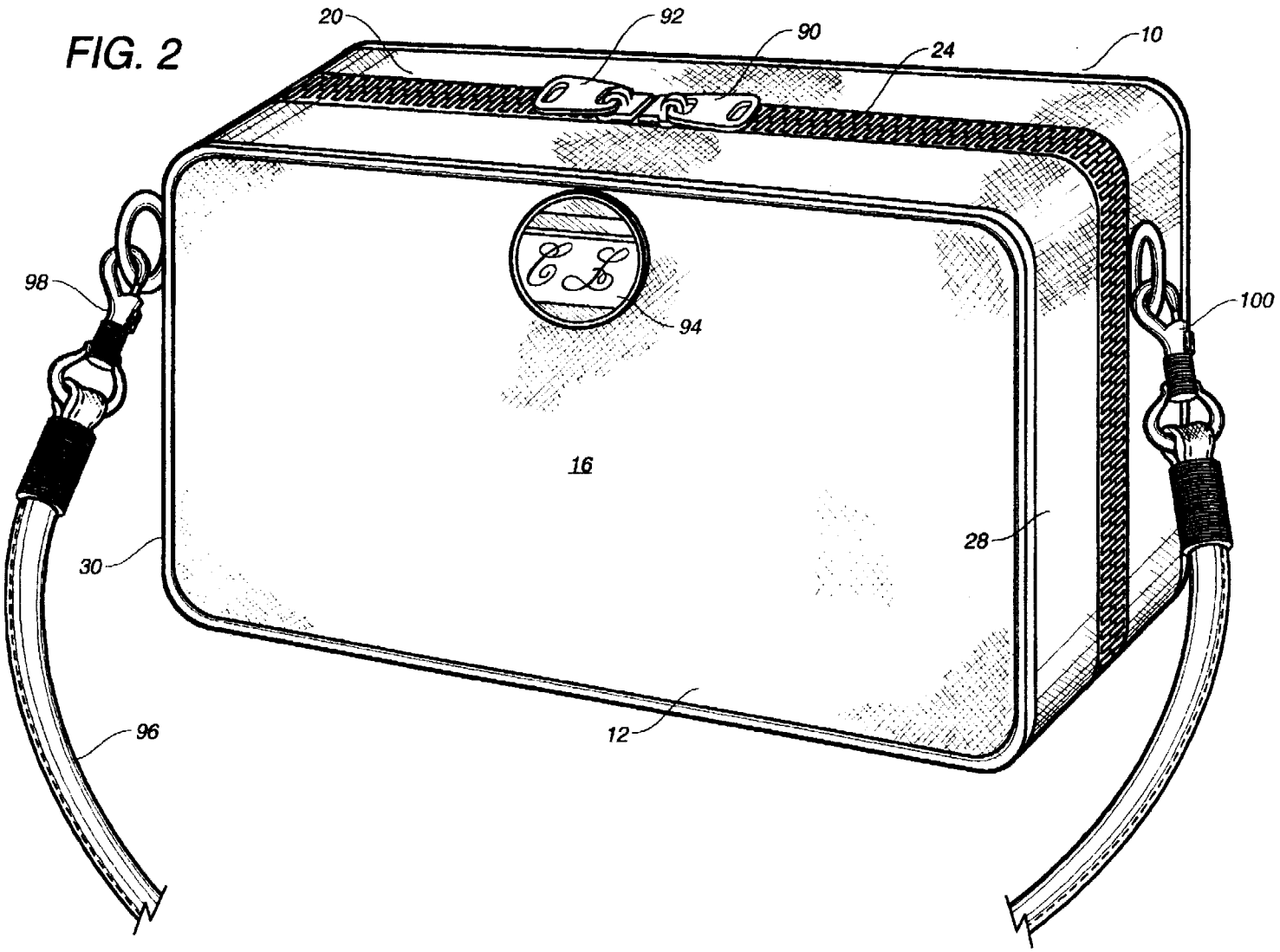
FIG. 2 is a perspective view of the exterior of the case of the personal article receptacle of the present invention.

FIG. 2 shows an isolated view of the closed personal article receptacle 10. In FIG. 2, it can be seen that the case 12 is closed by the zipping of the zipper 24. It can be seen that the zipper 24 is a double zipper that has tabs 90 and 92 meeting at the center of the top side 20 of case 12. The side panels 28 and 30 are closed when the tabs 90 and 92 meet. A personal tag 94 can be affixed to the front side 16 of the case 12 so as to allow for personal identification of the case 12. A readily removable strap 96 extends outwardly of the case 12. The strap 96 has one end 98 attached to the side panel 30 and an opposite end 100 attached to the side panel 28. The strap 96 allows the user to carry the personal article receptacle 10 in the same fashion as one would carry a purse.

Figure 3:
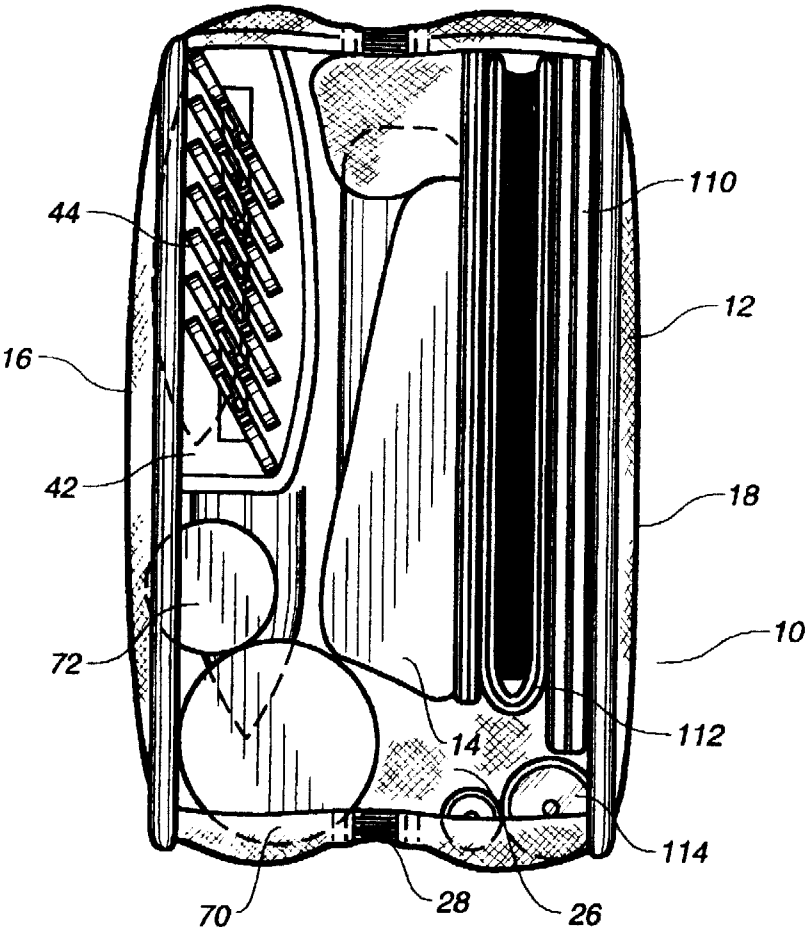
FIG. 3 is a view from the right hand side of the personal article receptacle.

FIG. 3 is a plan view of the personal article receptacle showing the interior of the case 12 when it is in its closed configuration. In particular, it can be seen that the eyeglass holder 14 forms a central partition on the interior 26 of the case 12. Credit cards and I.D. cards 110 are positioned on one side of the eyeglass holder 14. Similarly, the checkbook 112 is positioned on the same side as the identification cards 110. The penlight 114 can be positioned adjacent to the side wall 28 of case 12. The hair spray 70 and the breath spray 72 are provided on the opposite side of the eyeglass holder 14. The compact 44, the keys 42 and other personal items can also be positioned on this side of the eyeglass holder 14.

Figure 4:
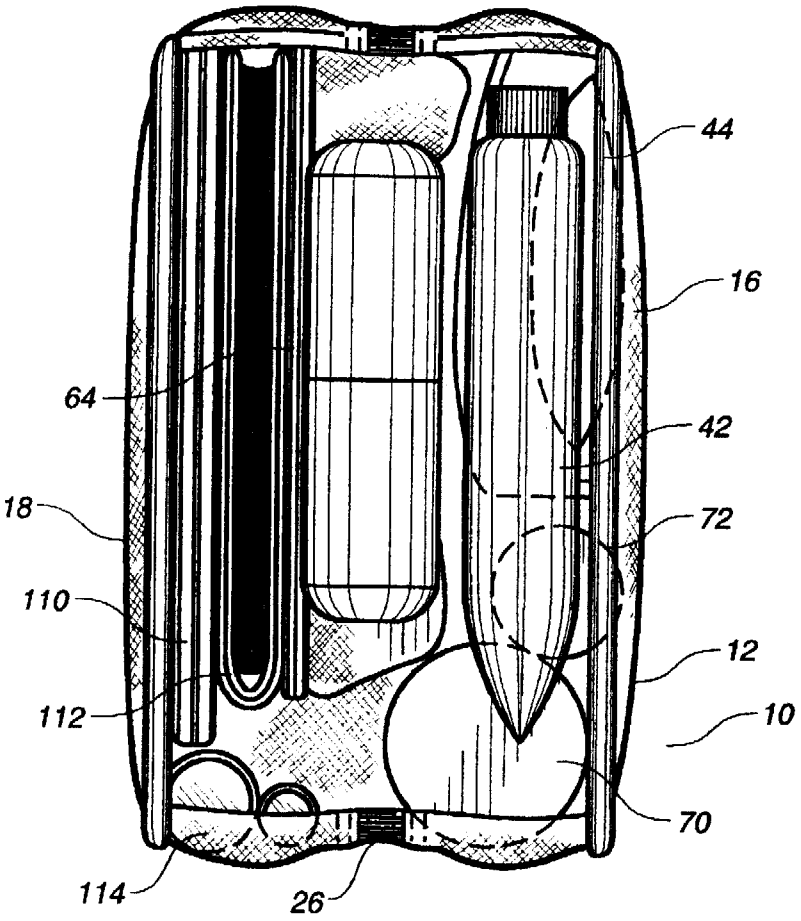
FIG. 4 is a view from the left hand side of the personal article receptacle.

FIG. 4 shows a reverse view of the interior configuration of the case 12. Of note in FIG. 4 is the use of the currency pouch 64 which is positioned between the checkbook 112 and the eyeglass holder 14.

In both of the illustrations of FIG. 3 and 4, it can be seen that the personal article receptacle 10 efficiently stores articles on the interior 26 of the case 12 and makes such articles easily available for access by the user. The eyeglass holder 14 contains eyeglasses between rigid sides so as to prevent any damage to the eyeglasses when they are stored on the interior 26 of the case 12.

Figure 5A:
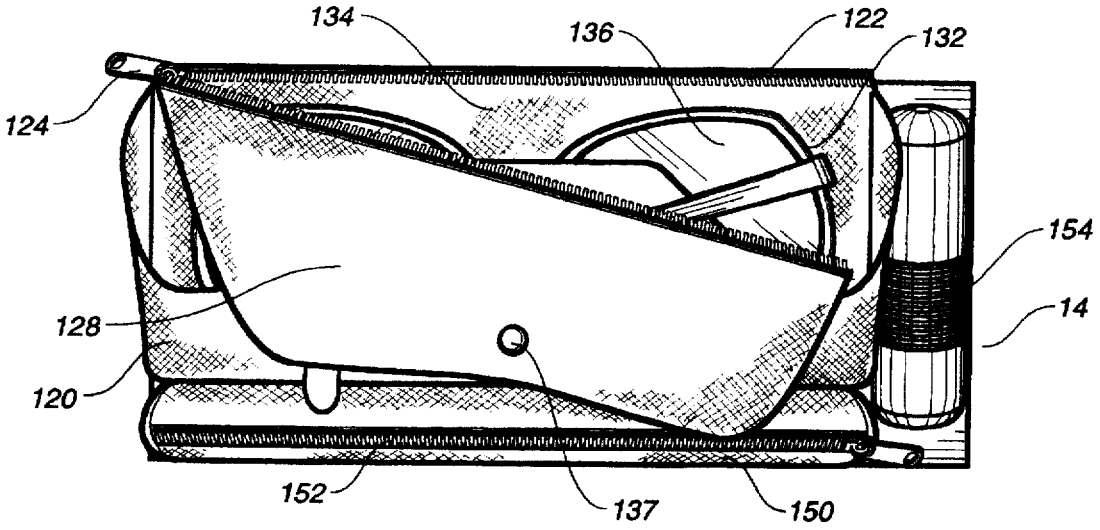
FIGS. 5A and 5B are isolated views of the eyeglass holder in accordance with the present invention showing the ways to access the eyeglasses from the eyeglass holder.
Figure 5B:
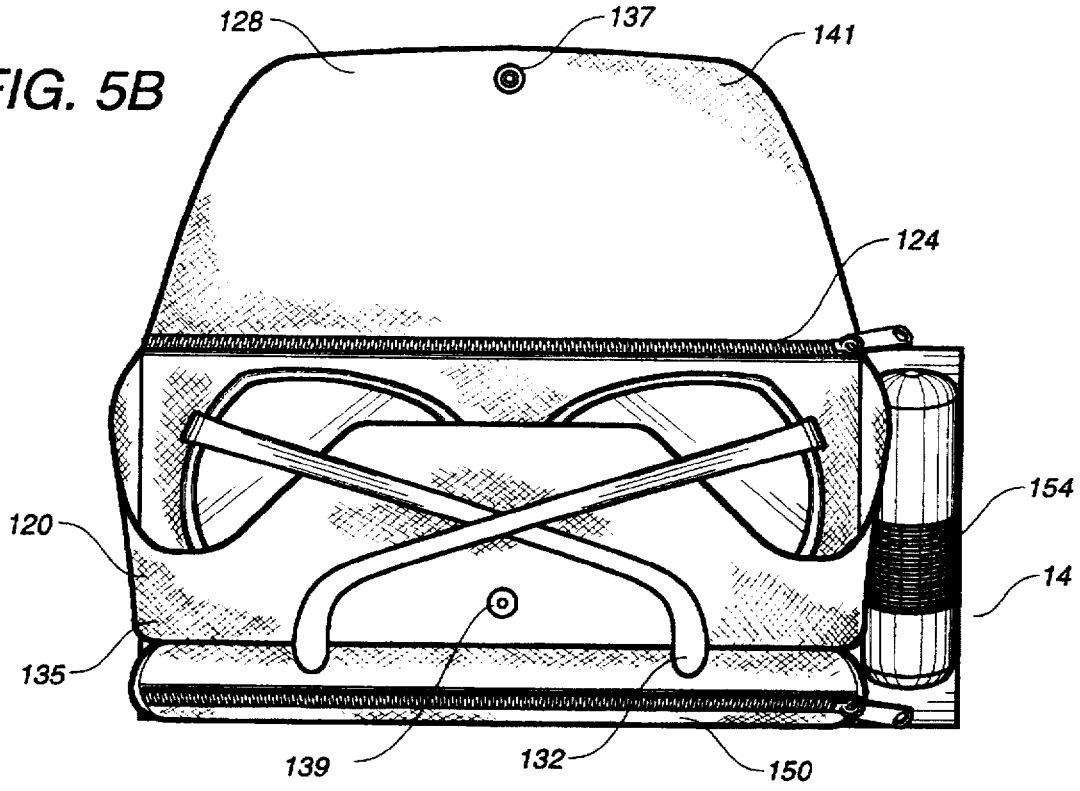

In FIGS. 5A and 5B, there are shown the ways in which the eyeglass holder 14 can be accessed so as to obtain the eyeglasses 132 from the interior of the eyeglass holder 14. FIG. 5A shows how the zipper 124 can be opened so as to allow for access of the glasses 132 from the top of the carrying case. FIG. 5B shows how the eyeglasses 132 can be accessed from the interior of the eyeglass holder 14 by unsnapping the snap fastener 137.

According to FIG. 5A, it can be seen that the eyeglass holder has a generally rigid front side 120 and a generally rigid back side 122. A section of flexible material 128 is connected to the zipper 124 so as to extend outwardly from the back side 122 and overlap with the front side 120 of the eyeglass holder 14. A snap button 137 is formed on this material 128 so as to allow the flap to be opened from the front side of the eyeglass holder 14 (in the manner shown in FIG. 5B). The front side 120 and the back side 122 are made of a molded plastic material. The eyeglasses 132 are received on the interior of the eyeglass holder 14 between the front side 120 and the back side 122. A cushioned lining material is provided on the interior surface of the flap 128 and is also provided on the exterior surface of the front side 120. This cushioned lining material may be a foam material of a sufficient texture so as to prevent the shafts of the eyeglasses 132 from Getting bent, and other damage, from affecting the fragile wire shafts of the eyeglasses 132. The interior area of the eyeglass holder 14 is lined with felt 134 so as to prevent the lenses 136 from becoming scratched.

Since the zipper 124 is placed in proximity with the zipper 24 of the case 12, easy access to the interior of the eyeglass holder can be accomplished by unzipping the top side 20 of the case 12 and then by unzipping the zipper 124. When the zipper is open, the eyeglasses can be accessed and removed without fully opening the carrying case.

A pouch 150 is also affixed to the eyeglass holder 14 below the eyeglasses 132. The pouch 150 has a zipper 152 extending across a surface of the pouch 150. The zipper 152 permits easy access to the interior of the pouch 150. A lipstick holder 154 is also connected to the eyeglass holder 14 at one side of the eyeglass holder.

FIG. 5B shows the eyeglass holder 14 in which the eyeglasses 132 can be accessed in a conventional fashion. In FIG. 5B, it can be seen that the flap 128 has a snap button 137 affixed thereto. The snap button 137 can be releasably attached to the snap fastener 139 positioned on the generally rigid front side 120 of the eyeglass holder 14. In the embodiment shown in FIG. 5B, there is a cushioned lining material 135 affixed to the exterior surface of the front side 120. There is also a cushioned lining material 141 provided on the interior surface of the flap 128. When the snap button 137 is secured to the snap fastener 139, the flap 128 will be closed so as to secure the eyeglasses 132 therein. When the snap button 137 is released from the snap fastener 139, the eyeglasses 132 can be accessed in the manner of a conventional eyeglass case. The lipstick holder 154 and the pouch 150 are secured to the back rigid side 134 of the eyeglass holder 14.

Figure 6:
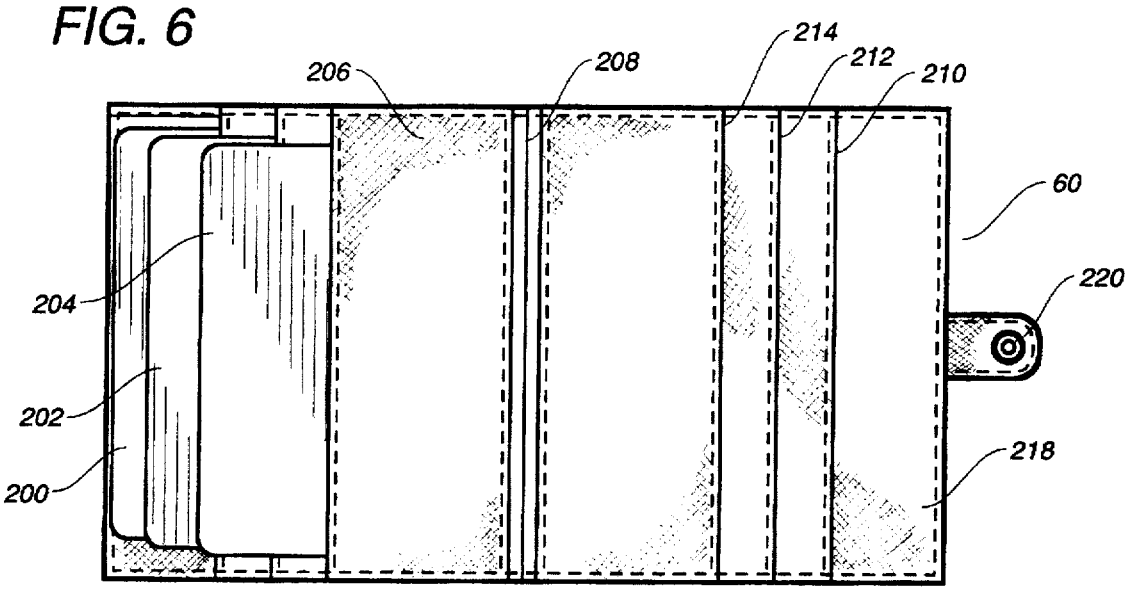
FIG. 6 is a plan view of the unfolded credit card holder as used in the personal article receptacle of the present invention.

FIG. 6 is an isolated view of the credit card holder 60 as used in the present invention. As can be seen, credit cards 200, 202, and 204 are fitted into one side 206 of the credit card holder 60. A fold line 208 is formed centrally of the body of the credit card holder 60. Similarly, credit cards can be received within the slots 210, 212, and 214 on the other side 218 of the credit card holder 16. A snap button 220 is provided so as to allow the credit card holder 16 to be closed. The credit card holder is designed to be left open while within the case. This allows separate pieces of identification to be removed while the holder remains within the receptacle. The holder can be removed (along with checkbook or key case) from the receptacle. The holder can then be folded and snapped shut to enable the user to carry these items in another purse.

Figure 7:
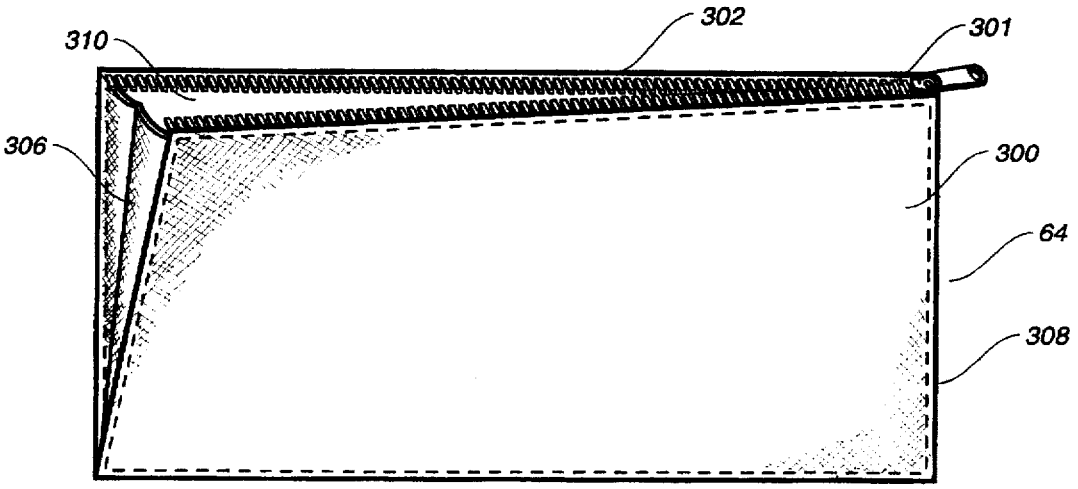
FIG. 7 is an isolated view of the currency pouch as used in the personal article receptacle of the present invention.

FIG. 7 is an isolated view of the currency pouch 64. The currency pouch 64 has a front side 300 and a back side 302. A zipper 304 extends along the top edge of the currency pouch 64. The sides 306 and 308 are flexibly expandable so as to allow for receipt of currency into the interior 310 of the currency pouch 64. The currency pouch 64 is not removable.

FIGS. 8A–E show the construction of the eyeglass holder 14 in accordance with the preferred embodiment of the present invention. Initially, in FIG. 8A, it can be seen that the back side 134 of the eyeglass holder 14 is a generally rectangular sheet of plastic. Holes 400 are provided on and through the back side 134 so as to allow the eyeglass holder to be secured thereto. The bottom edge 401 of the back side 134 can be affixed to the interior bottom of the receptacle within the carrying case 12 of the present invention.

Figures 8A, 8B, 8C, 8D, 8E:
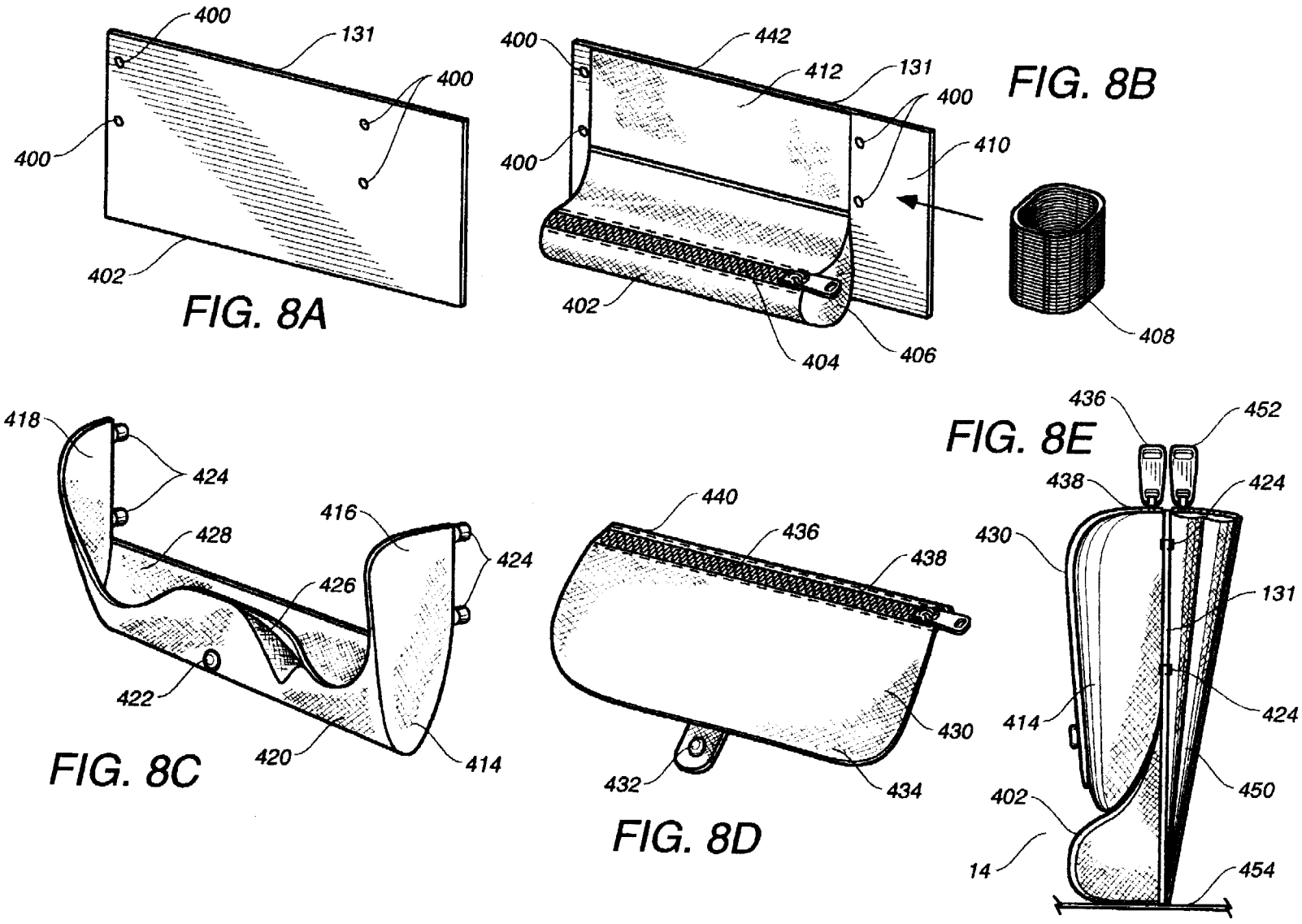
FIGS. 8A–E are various perspective views of the construction and components of the eyeglass holder of the present invention.

FIG. 8B shows that a flexible pouch 402 is affixed to the lower portion of the back side 134. The pouch 402 has an interior area 406 that is suitable for the receipt of personal articles. A zipper 404 extends longitudinally along the surface of the pouch 402. The pouch 402 has a length which is less than the length of the back side 134. The pouch 402 can be made of the same material as the interior lining of the carrying case 12. A lipstick holder 408 can be positioned on the side area 410 of the back side 134. The lipstick holder 408 is suitable for the receipt of various types of lipstick containers. A piece of felt 412 is affixed to the center of back side 134 above the position of the pouch 402. It is important to note that the back side 134 can be covered with the interior lining material of the case 12.

FIG. 8C shows the rigid portion of the eyeglass holder 414. The rigid portion 414 has sides 416 and 418 extending upwardly from a receptacle base 420. A snap button 422 is affixed to the outer surface of the receptacle base 420. Tabs 424 extend outwardly from the sides 416 and 418. The tabs 424 are received by the holes 400 in the back side 134. A layer of foam 426 is affixed to the front side of the receptacle base 420 of the eyeglass holder 414. Felt material 428 is affixed to the interior of the eyeglass holder 414. The eyeglass holder 414, as illustrated in FIG. 8C, is made of a molded plastic material. The tabs 424 are secured within the holes 400 by a conventional heat process.

FIG. 8D shows the flexible flap 430 as used on the eyeglass holder of the present invention. A snap button 432 is affixed along the bottom edge 434 of the flexible flap 430. The flap 430 is lined with the interior lining of the carrying case 12 over a layer of foam cushioned material. A zipper 436 is formed along the top surface 438 of the flexible flap 430. The upper edge 440 of the flexible flap 430 is affixed to the top edge 442 of the back side 134 (as shown in FIG. 8B).

FIG. 8E shows the configuration of the eyeglass holder 14 of the present invention. It can be seen that the flexible flap 430 extends outwardly from the back side 134. The zipper 436 is positioned on the top surface 438 of the flexible flap 430. The pouch 402 is positioned below the eyeglass holder structure 414 and is affixed to the front side of the back side 134. It can be seen that the tabs 424 are properly received within the holes 400 of the back side 134. The currency pouch 450 is shown in its open position. The currency pouch 450 is juxtaposed against the back surface of the back side 134. A zipper 452 is positioned adjacent to the top edge of the currency pouch 450. It can be seen that the back side 134 is affixed to the bottom side 454 of the carrying case 12 of the present invention. Additionally, the pouch 402 has its bottom surface juxtaposed against the bottom side 454.

The present invention enables persons that wear reading glasses or sunglasses intermittently, to carry a compact, organized tote that includes a hard, protected space for glasses. This space will protect the glasses, and prevent the glasses from getting scratched, bent, or lost. The present invention provides compactness with the ability to carry a maximum number of items in a minimum amount of space. The backbone of the case of the present invention is the center partition that includes the eyeglass holder 14. This can be molded from plastic and then covered to match the lining of the interior 26 of the case 12. The other items within the personal article receptacle 10 fit within the case 12 over and around each other in much the same fashion as a jigsaw puzzle. The present invention holds a very large number of items for its small size. When the case 12 is unzipped, not one single item must be touched in order to access and remove the desired item. the case 12 is designed to be fashionable and versatile and carried in any situation, with a business suit or casual dress, daytime or evening.

The foregoing disclosure and description of the invention is illustrative and explanatory thereof. Various changes in the details of the illustrated configuration may be made within the scope of the appended claims without departing from the true spirit of the invention. The present invention should only be limited by the following claims and their legal equivalents.

I claim:

1. A personal article receptacle comprising:

a case having a front side and a back side, said case having a length of less than eight inches and a width of less than five inches and a depth of less than three inches, said case having a zipper extending along at least three sides of said case; and an eyeglass holder permanently affixed to an interior of said case, said eyeglass holder having a front generally rigid side and a back generally rigid side, said front and said back generally rigid sides defining an eyeglass receiving space therebetween, said eyeglass holder having means for closing said eyeglass receiving space, said case having a first area on one side of said eyeglass holder for receiving a first set of personal articles, said case having a second area on an opposite side of said eyeglass holder for receiving a second set of personal articles, said means for closing said eyeglass receiving space comprising a zipper extending along a top edge of said eyeglass holder, said zipper extending along said top edge of said eyeglass holder being in proximity to said zipper extending along at least three sides of said case, said means for closing said eyeglass receiving space further comprising:

a flap affixed to said back generally rigid side of said eyeglass holder and extending over said front generally rigid side of said eyeglass holder, said flap having a snap button affixed thereto for releasably securing said flap to said front generally rigid side.

2. The receptacle of claim 1, said zipper extending along a top edge of said eyeglass holder being formed in said flap such that eyeglasses on an interior of said eyeglass holder can be accessed through said zipper extending along said top edge or by releasing said flap from said front generally rigid side of said eyeglass holder.

3. The receptacle of claim 1, said case having a generally rectangular configuration, said case having a depth dimension extending between said front side and said back side, said zipper positioned generally centrally of said depth dimension.

4. The receptacle of claim 3, said zipper being a double zipper meeting at a top side of said case.

5. The receptacle of claim 1, further comprising:

a removable strap extending outwardly of said case, said strap having one end connected to one side of said case, said strap having an opposite end connected to another side of said case.

6. The receptacle of claim 1, said eyeglass holder having said back generally rigid side directly affixed to a bottom side of said case on an interior of said case, said eyeglass holder extending upwardly from said back side.

7. The receptacle of claim 6, said zipper of said eyeglass holder being adjacent said means for opening said case.

8. A personal article receptacle comprising:

a case having a front side and a back side, said case having means for opening said case for accessing an interior of said case; and an eyeglass holder affixed to said interior of said case, said eyeglass holder having a front generally rigid side and a back generally rigid side, said front and said back generally rigid sides defining an eyeglass receiving space therebetween, said eyeglass holder having means for closing and opening said eyeglass receiving space, said eyeglass holder positioned centrally between said front side and said back side of said case, said back generally rigid side of said eyeglass holder being affixed to a bottom side of said case, said eyeglass receiving space opening toward a top side of said case, said eyeglass holder having a section of flexible material extending between said front and back generally rigid sides, said section of flexible material having a zipper extending therealong, said interior of said case being covered with a lining material, said front and back generally rigid sides of said eyeglass holder having an exterior surface covered with a similar lining material.

9. The apparatus of claim 8, said section of flexible material being a flap extending from said back generally rigid side to said front generally rigid side, said flap having a snap means affixed thereto for securing said flap to said front generally rigid side.

10. The receptacle of claim 8, each of said front generally rigid side and said back generally rigid side having a foam material surface affixed thereto.

11. The receptacle of claim 8, said eyeglass holder defining a central partition on said interior of said case, said case having a first area on one side of said eyeglass holder for receiving a first set of personal articles, said case having a second area on an opposite side of said eyeglass holder for receiving a second set of personal articles.

12. The receptacle of claim 11, said eyeglass holder having a height less than a height of said case, said case having a third area on a top of said eyeglass holder for receiving a third set of personal articles.

13. The receptacle of claim 12, said eyeglass holder having a length less than a length of said case, said case having a fourth area at an end of said eyeglass holder for receiving a fourth set of personal articles, a pouch being affixed to said eyeglass holder adjacent said bottom side of said case, said pouch for receiving a fifth set of personal articles.

14. The case of claim of 8, said case having a length of less than eight inches and a width of less than five inches and a depth of less than three inches, said means for opening being a zipper extending along at least three sides of said case.

15. A personal article receptacle comprising:

a case having a front side and a back side, said case having means for opening said case for accessing an interior of said case; and an eyeglass holder affixed to said interior of said case, said case having a first area on one side of said eyeglass holder for receiving a first set of personal articles, said case having a second area on an opposite side of said eyeglass holder for receiving a second set of personal articles, said eyeglass holder having an eyeglass receiving space between a front side and a back side of said eyeglass holder, said front side and said back side of said eyeglass holder being of a generally rigid configuration, said front side and said back side of said eyeglass holder having a cushioned material affixed to an exterior surface thereof, said eyeglass holder having a section of flexible material extending between said front side and said back side, said section of flexible material having a zipper extending therealong, said zipper of said eyeglass holder being adjacent and longitudinally aligned with said means for opening said case, said section of flexible material being a flap extending from one of said front and back sides so as to overlap the other of said sides, said eyeglass holder having a snap button affixed thereto such that said flap can be releasably secured to one of said rigid sides for containing the eyeglasses therein.

* * * * *